United States Patent [19]

Bethurum

[11] 4,274,197

[45] Jun. 23, 1981

[54] METHOD OF MAKING AN ENVIRONMENTAL SEAL

[75] Inventor: Gary C. Bethurum, El Segundo, Calif.

[73] Assignee: Thomas & Betts Corporation, Raritan, N.J.

[21] Appl. No.: 77,560

[22] Filed: Sep. 21, 1979

[51] Int. Cl.[3] ..... H01R 43/04

[52] U.S. Cl. ..... 29/861; 29/857

[58] Field of Search ..... 29/857, 861, 844; 174/74 R; 339/17 F, 94 A, 94 M, 99 R, 97 P, 94 C

[56] References Cited

U.S. PATENT DOCUMENTS

| | | | |
|---|---|---|---|
| 3,434,093 | 3/1969 | Wedekind . | |
| 3,444,506 | 5/1969 | Wedekind . | |
| 3,571,779 | 3/1971 | Collier | 339/94 M X |
| 3,816,818 | 6/1974 | Meier . | |
| 3,930,708 | 1/1976 | Wedekind et al. . | |
| 4,077,695 | 3/1978 | Bakermans . | |

FOREIGN PATENT DOCUMENTS

| | | | |
|---|---|---|---|
| 2029235 | 12/1971 | Fed. Rep. of Germany | 29/625 |
| 45-6371 | 3/1970 | Japan | 339/17 F |

*Primary Examiner*—Charlie T. Moon
*Assistant Examiner*—C. J. Arbes
*Attorney, Agent, or Firm*—Robert M. Rodrick; Jesse Woldman

[57] ABSTRACT

The method for creating an environmental seal for the end of a severed multiconductor cable and for sealing the joints between the conductors of such cable with the contacts of a multiple contact connector into which such cable is inserted. A tape of a soft, pliant material is coated on both sides with a flowable, pressure-sensitive adhesive and is formed into a blank which can be adhered to the cable in various ways. In a first form, the blank encompasses the severed end and portions of the cable adjacent the end. When the connector into which the cable has been inserted is compressed, the adhesive is displaced to seal the contact-conductor joints. Folded-over end flaps seal the cable ends. A midspan use of the blank permits the joints to be sealed without reference to the cable end.

6 Claims, 8 Drawing Figures

METHOD OF MAKING AN ENVIRONMENTAL SEAL

BACKGROUND OF THE INVENTION

1. Field of the Invention

The invention is directed to the environmental sealing of severed cable ends and/or the sealing of the joints between the individual conductors of a multiconductor cable and the contacts of a multicontact electrical connector into which the cable has been inserted.

2. Description of the Prior Art

In the prior art, environmental seals for cables and/or cable connector joints were achieved through the use of complex connectors having various seals and gaskets to prevent the entrance of moisture, dirt, or contaminants into the connector. These connectors had a great many parts, required skilled preparation of the cable and installation of the connector, required special tools and could not be easily carried out under field conditions. Potting was also an available technique to seal the cable and connector-conductor joints. Special preparation of the cable and connector was required, and since the potting equipment was not generally portable, it could not be carried out in the field. Also, after a cable-connector was potted, any failure of the cable or connector required its being cut off and discarded since the attempted removal of the potting compound could result in the destruction of the connector. A simple, if not completely reliable, approach was to wrap the cable-connector joint with many layers of various tapes to provide the necessary moisture seal, dielectric strength, etc. Such sealing was not reliable since pinholes in the tape often admitted moisture and provided leakage paths. Also, no effective seal could be obtained for the connector-conductor joints within the connector.

SUMMARY OF THE INVENTION

The present invention overcomes the difficulties noted above with respect to prior art devices by providing a method for environmentally sealing the severed end of a multiconductor cable and/or sealing the joints between the individual conductors of such cable and the associated contacts of the multicontact electrical connector into which such cable is inserted. A sealing material is formed from a tape of a soft pliant material and coated on both sides with a flowable pressure-sensitive adhesive. Blanks are formed from the sealing material having specific lengths and widths with respect to the cable to be sealed and the manner in which the seal is to be applied. For a seal of the severed end of the cable only, a blank as wide as the cable and approximately twice as long as the length of cable necessary to get proper adherence of the blank to the cable is formed. The blank is formed into a U-shape into which the severed cable end is inserted and the legs adhered to the opposite cable surfaces. If the blank is made wider than the cable, the overlapped wings beyond the cable can be joined to each other and then folded back and adhered to the blank adhered to the cable to seal the cable ends.

To seal the cable at midspan, one wrap of the blank about the cable in the area where the connector is to be applied is necessary. Again, wings beyond the cable width can be sealed and folded back to seal the cable edges. The closure of connector into which the prepared cable is inserted displaces some of the adhesive to seal the potential tracking paths between adjacent contacts along the cable surface. Further, the adhesive adheres to the connector sealing the conductor contact joints from environmental attack.

A seal applied at the severed cable end and extending along the cable length, a distance equal to the length of the connector along the longitudinal axis of the cable can be used to provide an environmental seal for both the severed cable end and the joints between the conductors of the cable and their associated contacts of the electrical connector into which the cable is inserted. It is therefore an object of this invention to provide an improved environmental seal for a cable and/or cable-connector joint.

It is an object of this invention to provide an inexpensive, simple, easily installed environmental seal for a cable and/or cable-connector joint.

It is an object of this invention to teach a method for forming an environmental seal about a severed cable end and/or the joint between the conductors of a multiconductor cable and the associated contacts of a multicontact electrical connector into which such cable is placed.

It is an object of this invention to teach a method for forming an environmental seal about a severed cable end.

It is still another object of this invention to teach a method for forming an environmental seal for the joint between the conductors of a multiconductor cable and the associated contacts of a multicontact electrical connector into which such cable is inserted.

Other objects and features of the invention will be pointed out in the following description and claims and illustrated in the accompanying drawings, which disclose, by way of example, the principle of the invention, and the best mode which has been comtemplated for carrying it out.

BRIEF DESCRIPTION OF THE DRAWINGS

In the drawings in which similar elements are given similar reference characters.

DESCRIPTION OF THE PREFERRED EMBODIMENT

Figure 1:
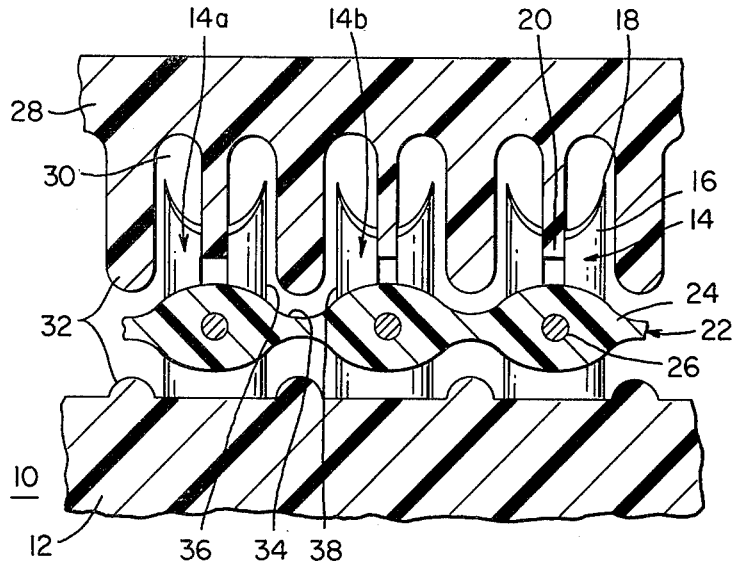
FIG. 1 PRIOR ART
FIG. 1 is a fragmentary front elevational view, partially in section, of a prior art multicontact electrical connector applied to a multiconductor cable inserted therein.
Figure 2:
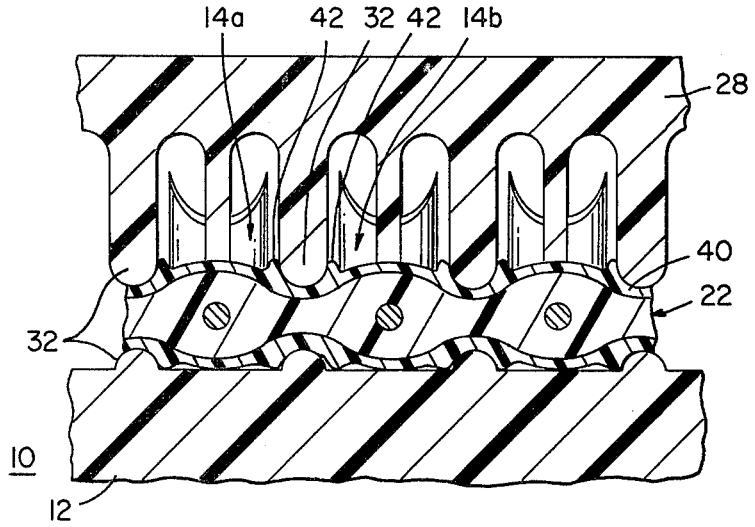
FIG. 2 is a reproduction of FIG. 1 with a seal applied according to the method taught by this invention.

Turning now to FIGS. 1 and 2, the utility of the present sealing method can best be appreciated. A connector 10 of the type shown, described and claimed in U.S. Pat. No. 3,964,816 issued June 29, 1976 to Ronald S. Narozny entitled "Electrical Contact" and assigned to the assignee of the instant invention, is used to join the individual conductors of a multiple conductor flat cable to other electrical junction points (not shown). Connector 10 has a base 12 from which extends a plurality of electrical contacts 14 of the insulation piercing type. Arms 16, sharpened as at 18, pierce the insulation 24 of the cable 22 and direct the individual conductors 26 into the contact slots 20. Because of the relative dimensions of the conductors 26 and the slots 20, a good electrical contact is made therebetween. A top 28 having annular rings 30 therein overlies the base 12 to clamp the cable 22 in the connector 10. Latches (not shown) hold connector 10 and cable 22 in assembly. Guide ribs 32 on both the base 12 and top 28 serve to guide the cable 22 into connector 10 so as to place the individual conductors 26 over the contact slots 20.

To use connector 10, the base 12 and top 28 are arranged at a prelatch position so that a space exists between the tops of contacts 14 and the bottom surface of top 28 to receive a cable 22 inserted therein. The cable 22 is guided to its proper position in the connector 10 by the guide ribs 32 on the base 12 and top 28. Thereafter, top 28 is compressed upon the cable 22 and base 12 causing the sharpened tops 18 of the arms 16 of contacts 14 to tear the insulation 24 of cable 22 and direct the individual conductors 26 into the slots 20 of the contacts 14. The arms 16 of the contacts 14 then enter the annular rings 30 of top 28 which holds the contacts 14 tightly closed upon the conductors 26. The assembled position of cable 22 and connector 10 is held by the latches (not shown). An open path extends along the surface 34 of cable 22 between exposed portions 36, 38 of adjacent contacts **14*a* and 14*b*. Thus, if moisture, dirt, oil or other surface contaminants collect along the open path, a leakage path or direct electrical short can be created between the contacts 14*a* and 14*b*. Similar open paths extend between all adjacent contacts along both surfaces of cable 22 adjacent base 12 and top 28**.

A seal according to the method taught by the invention seals not only the exposed ends of the individual conductors 26 of cable 22 inserted into connector 10 but also seals the open paths between adjacent contacts along the cable 22 surface. A tape 40 made of a soft, pliant material such as rubber, plastic, etc., having a durometer reading of 10 or less and coated on both sides with a soft, flowable, pressure-sensitive adhesive is placed on both surfaces of cable 22 according to the method to be described below. The cable 22 with tape 40 applied is now inserted into the connector 10 and the top 28 compressed upon the cable 22 as described with respect to FIG. 1. The guide ribs 32 cause the adhesive adjacent thereto to extrude, deform or otherwise be displaced to seal the space between the contact arms 16 and the ribs 32 as at 42 and close the path between contacts **14*a* and 14*b* preventing leakage, shorting or flashover. The adherence of the cable 22 to the base 12 and top 28 further seals the joints between the contacts 14 and the associated conductors 26**. With such arrangement the environmental elements are prevented from entering the connector and disrupting the cable contact joints.

Figure 3:
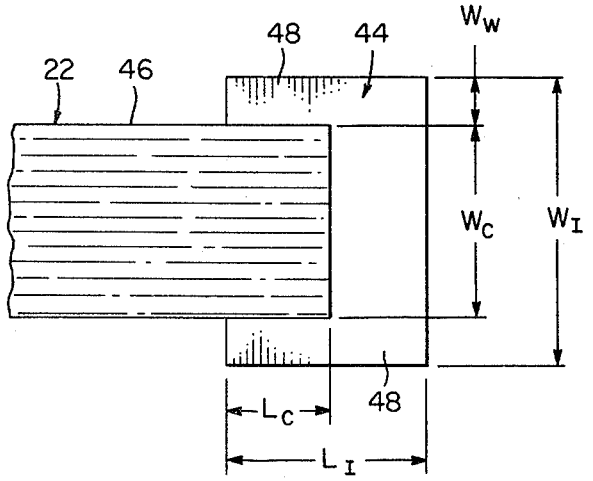
FIG. 3 is a top plan view of a length of multiconductor cable placed atop a blank of sealing material according to one step of the method taught by the invention.
Figure 4:
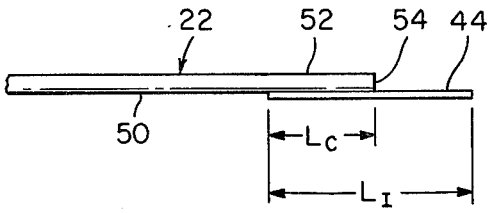
FIG. 4 is a side elevational view of FIG. 3.
Figure 5:
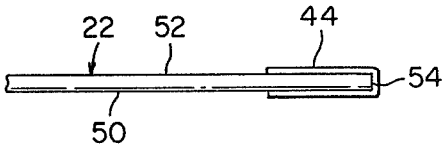
FIG. 5 is a side elevational view of FIG. 4 showing a further step in the method taught herein.

Turning now to FIGS. 3 to 8, the method of installing the seal is set forth. A blank 44 is cut from tape 40 having a width $W_I$ somewhat greater than twice the width of cable $W_C$, and a length $L_I$ somewhat greater than twice the length of the connector $L_C$ measured along the longitudinal axis of the cable. The cable 22 is placed upon the blank 44 at approximately the center of the length and width. Adjacent the marginal edges 46 of the cable 22 extend wings 48 which extend beyond the cable 22. With the cable 22 thus positioned over the blank 44, the release paper or protective coating of the blank 44 (not shown) is removed and the blank 44 adhered to the cable 22 first surface 50, as is seen in FIGS. 3 and 4. Next, the blank 44 is extended along the severed end 54 of the cable 22 and made to overlie the second surface 52 to which it is adhered, as is shown in FIG. 5.

Figure 6:
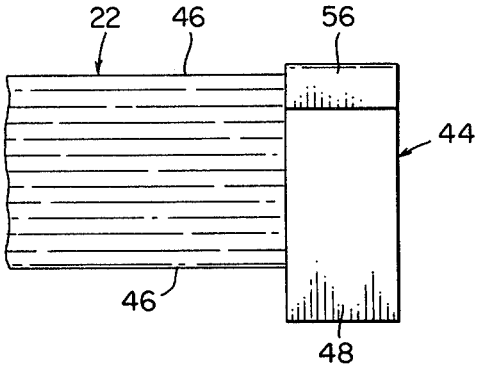
FIG. 6 is a top plan view of the cable and seal blank showing yet another step of the method hereof.
Figure 7:
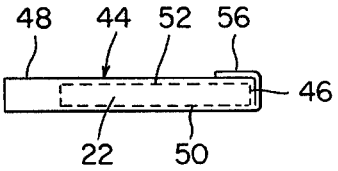
FIG. 7 is a front elevational view of the cable and seal blank of FIG. 6.
Figure 8:
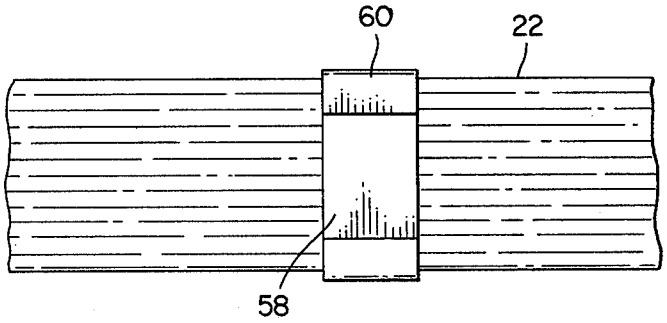
FIG. 8 is a top plan view of a midspan cable seal applied according to the method hereof.

Now the wings 48, extending beyond marginal edges 46, are pressed together causing them to adhere to themselves and the wing 48 is then folded back as shown in FIGS. 6 and 7 to overlie a portion of the blank 44 over second surface 52 of cable 22 and adhered to the blank 44 to seal the marginal edges 46 of cable 22. The remaining wing 48 will similarly be sealed and folded back.

To seal midspan a cable 22 to which a connector is to be applied, a blank 58 can be prepared from tape 40. The blank 58 can be a single piece or two pieces having a combined length greater than twice the width of cable 22 and a length along the cable 22 longitudinal axis equal to the length of the connector along such axis. The blank 58 is placed over the location for the connector and the wings are formed and folded back as at 60 in FIG. 8. The use of this seal will be as above described.

While there have been shown and described and pointed out the fundamental novel features of the invention as applied to the preferred embodiment, it will be understood that various omissions and substitutions and changes of the form and details of the device illustrated and in its operation and of the method taught may be made by those skilled in the art, without departing from the spirit of the invention.

The embodiments of the invention in which an exclusive property or privilege claimed are defined as follows:

1. The method of environmentally sealing the end of a severed multiconductor cable having a first surface and a second surface and sealing joints between the conductors of such cable and electrical contacts to be placed in insulation-piercing relation with said cable, comprising the steps of: forming a blank of a soft, pliant tape having a flowable pressure-sensitive adhesive on both surfaces thereof, said blank being at least as wide as such cable and having a length at least equal to the lengths between such joints and such cable end; adhering a portion of said blank to a first surface of such cable adjacent its severed end; extending the remainder of said blank over the severed end of such cable to overlie the second surface of such cable adjacent such severed end; adhering the overlying portion of said blank to said second surface; and joining said contacts and said conductors by forcing said contacts through said blank.

2. The method of claim 1, wherein said blank is formed substantially wider than such cable and comprising the further steps of adhering the portions of said blank extending beyond the marginal edges of such cable to itself and extending the joined blank portions back over the portion of the blank adhered to the cable and adhering the joined blank portions thereto.

3. The method of environmentally sealing the end of a severed multiconductor cable having a first surface and a second surface and sealing the joints between the conductors of such cable with a multiple contact connector into which the severed end of such cable is inserted comprising the steps of: forming a blank of a soft, pliant tape having a flowable pressure-sensitive adhesive on both surfaces thereof, said blank being at least as wide as such cable and at least twice the length of the portion of such cable to be inserted within such connector; adhering a portion of said blank to a first surface of such cable adjacent its severed end; extending the remainder of said blank over the severed end of such cable to overlie the second surface of such cable adjacent such severed end; adhering the overlying portion of said blank to said second surface; inserting the cable with blank attached into a connector; and compressing the connector to cause said adhesive to flow about the joints between the cable conductors and their associated connector contacts.

4. The method of claim 3, wherein said blank is formed substantially wider than such cable and comprising the further steps of adhering the portions of said blank extending beyond the marginal edges of such cable to itself and extending the joined blank portions back over the portion of the blank adhered to the cable and adhering the joined blank portions thereto.

5. The method of sealing the joints between the conductors of a multiconductor cable with the contacts of a multiple contact connector into which such cable is inserted comprising the steps of: forming a blank of a soft, pliant tape having a flowable pressure-sensitive adhesive on both surfaces thereof, said blank having a length at least equal to the lengths of the connector in the direction of the longitudinal axis of such cable and a width at least equal to the width of the cable transverse to the longitudinal axis of the cable; adhering a portion of said blank width across the width of the first surface of such cable; extending the remainder of said blank width over a marginal edge of said cable and along the second surface of such cable aligned with said portion of said blank adhered to said first surface; adhering the overlying portion of said blank to said second surface, inserting the cable with the blank attached into a connector; and compressing the connector to cause said adhesive to flow about the joints between the cable conductors and their associated connector contacts.

6. The method of claim 5, wherein said blank is formed substantially wider than such cable and comprising the further steps of: positioning said blank with respect to said cable width to form extensions at each of the two marginal edges of said cable and folding such extension back upon and over the portions of the blank adhered to such cable to seal the marginal edges of such cable.

* * * * *